US005605019A

United States Patent [19]

Maziekien et al.

[11] Patent Number: 5,605,019

[45] Date of Patent: Feb. 25, 1997

[54] FOLDABLE AND EXPANDABLE PITCH POCKET AND METHOD OF FORMING SAME

[76] Inventors: Dennis E. Maziekien, 116 Hillside Ave., Watchung, N.J. 07060; Edward F. Maziekien, 1204 Bay Ave., P.O. Box 884, Mantoloking, N.J. 08738

[21] Appl. No.: 231,339

[22] Filed: Apr. 22, 1994

[51] Int. Cl.[6] ..... E04D 13/14

[52] U.S. Cl. ..... 52/58; 52/60; 52/61

[58] Field of Search ..... 52/58, 60, 61

[56] References Cited

U.S. PATENT DOCUMENTS 2,271,143 1/1942 Martinus ..... 52/58

3,802,131 4/1974 Resech ..... 52/60

3,838,544 10/1974 Hindall ..... 52/60

4,890,426 1/1990 Hickman et al. ..... 52/60

*Primary Examiner*—Carl D. Friedman

*Assistant Examiner*—W. Glenn Edwards

*Attorney, Agent, or Firm*—John T. Peoples

[57] ABSTRACT

A foldable and expandable pitch pocket for encompassing an element such as a vent pipe protruding from a roof structure. The pitch pocket is initially an elongated piecepart which is arranged with slits on a horizontal wall and notches on the vertical wall aligned with the slits, thereby making it feasible to use light hand pressure to bend creases in the vertical wall to obtain the folded pitch pocket. A slot and tab cooperatively arranged interlock the vertical wall to fixedly hold the folded shape of the pitch pocket.

7 Claims, 3 Drawing Sheets

FOLDABLE AND EXPANDABLE PITCH POCKET AND METHOD OF FORMING SAME

BACKGROUND OF THE DISCLOSURE

1. Field of the Invention

This invention relates to materials used in connection with a roof of a building structure and, more particularly, to a pitch pocket utilized to flash around protuberances which destroy the integrity of the roof, and the concomitant methodology for fabricating the pitch pocket.

2. Description of the Background Art

Due to the virtually limitless variety of architectural designs for buildings, there are very few standardized building dimensions, including the layout of each building's roof. Building elements such as vent pipes, anchors, and conduits penetrate the roof and, to avoid water leaks in the roof, it is required to flash the elements with a pitch pocket (or pan). A pitch pocket is essentially a mechanical device which rests on the roof and which is adapted to form a loose enclosure around each dement so as to retain flashing material such as roof tar in place during pouring and solidification. Older style pitch pockets were only manufactured in a few standard sizes. More recently, to ensure a waterproof enclosure and optimal use of flashing material, it has become the practice in the roofing industry to custom fabricate pitch pockets in a specialty sheet metal shop. Oftentimes, however, the pitch pockets are not properly sized due to inaccurate measurements or mis-communication about the measurements. Severe sizing problems ultimately lead to delays with a concomitant increase in the cost of installing or repairing roofs.

One type of conventional pitch pocket (including a custom one) is constructed using a number (e.g., 2 or 4) of separate metal pieces which are placed to encompass the protuberance, and then the individual pieceparts are joined together mechanically to form a composite pitch pocket which is typically anchored in place with nails or screws. A tool is usually used to form the pieceparts into a unitary pocket, requiring a degree of skill and dexterity. Also, hardware such as fasteners are often utilized to permanently join the pieceparts. Again, such detail-oriented procedures for forming the pocket are time consuming and therefore costly. Another problem area arises because the pieceparts are of a rigid, pre-formed shape to ensure that the pieceparts mate in a cooperative fashion. Representative of this conventional type of pitch pocket is U.S. Pat. No. 3,838,544 issued to Hindall. As disclosed by Hindall, four identical corner units are adapted for interfitting by forming each unit with two perpendicular, L-shaped walls and arranging one wall of a unit with a slot for accepting the grooved wall of another unit. However, such pre-formed shapes have the deleterious effect of making it difficult and costly for the roofer or supplier to inventory and store such a variety of sizes and shapes. In addition, a completed, square-shaped pitch pocket results in four seams (one in the middle of each side wall), each of which can become a potential weak point in the assembly. Finally, the pitch pocket of Hindall is time-consuming to fabricate because of the difficulty in forming the piecepart with a permanent right-angle bend.

Recently, as disclosed by U.S. Pat. No. 4,934,117, a circularly-shaped, plastic-type of pitch pocket has been devised with the intent of eliminating roof anchors. However, this pocket is manufactured as a unitary piece and the integrity of the pocket can only be maintained in new-type construction wherein the pocket can be slipped over the free-end of a protruding element such as a vent pipe. In pre-existing construction without access to a free end of an element, the plastic pocket must be cut and then spread apart to be placed around the element, thereby ruining the integrity of the unitary piece. Once cut, it is cumbersome to re-shape and maintain the pocket in place in order to maintain a water-tight seal. Moreover, the circularly shape piecepart is not conductive to storage because the pieceparts are bulky and not readily stackable.

SUMMARY OF THE INVENTION

These shortcomings and other limitations and deficiencies are obviated in accordance with the present invention by a modular pitch pocket which is both foldable and expandable.

Broadly, in accordance with the structural aspect of the present invention, an illustrative pitch pocket is formed from a light-gauge metal into an elongated piecepart, L-shaped in cross-section, having a horizontal wall and a vertical wall. The vertical wall forms a retainer for the pool of flashing material which will eventually be introduced at the work site. The horizontal wall is a smooth, flat surface for anchoring to the roof membrane. In the illustrative embodiment, three notches in the vertical wall are cooperatively aligned with three full-width slits in the horizontal wall; the slits divide the horizontal wall into a plurality of basically equally-sized flaps. This arrangement of three notch-slit pairs allows an installer, using only light hand pressure, to bend three creases in the vertical wall at three different points of least resistance to thereby generally form a square piecepart. To fill in voids between the flaps at the four horizontal corner sections of the folded piecepart, the initially unfolded piecepart includes four corner fillers that are fastened to the bottom of the horizontal flaps to overlap the slits; the fillers are sized so that there are no voids in the composite horizontal wall formed from the flaps and fillers whenever the piecepart is folded. In order to interlock the folded pitch pocket, a narrow vertical slot is cut proximate to one end of the vertical wall and a mitered tab is formed at the opposite end of vertical wall; the tab also has a number of horizontally-oriented fingers at its free-end. Once folded into a square piecepart, the tab slides into the slot and the fingers can be folded with light hand pressure. The clearance of the tab-in-slot juncture is selected so as not to permit flashing material seepage prior to solidification.

In addition, since the tab and slot are on opposite ends of the unfolded vertical wall, it is now possible to link one unfolded piecepart to a second unfolded piecepart to form a corner junction, a seriatim, to thereby form a modular combination allowing for a variety of shapes, including rectangular, octagonal, or even irregular shapes. This modularity provides the installer far more flexibility and will conserve the amount of pourable flashing needed at the work site.

Broadly, in accordance with the method aspect of the present invention, one illustrative method includes the following steps applied to raw stock of light-gauge metal: (1) shearing the stock to form: a flattened piecepart which can be bent into the vertical and horizontal walls; the tab end; and the horizontal fillers; (2) bandsawing: the slits in the part of the stock forming the horizontal wall; the fingers at the end of the tab; and the notches in the part of the stock forming the vertical wall; (3) punching the slot at the end of the stock opposite to the tab; (4) bending the flat piecepart to form the horizontal and vertical walls as well as the mitered tab; and (5) spot welding the horizontal fillers to the underside of the horizontal wall to overlap the horizontal slits.

A feature in accordance with the present invention is that the pitch pocket needs no other components parts such as fasteners. In addition, since the pitch pocket is especially adapted to be both foldable and expandable, a pitch pocket of any practical dimension can be easily fabricated at the field location using a few standard sizes. Finally, because the unfolded piecepart is L-shaped, it is possible to readily stack a large number of pieceparts together to minimize the storage space for the pieceparts.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

After considering the following description, those skilled in the art will clearly realize that the teachings of my invention can be readily utilized in providing adjustable and expandable pitch pockets.

Figure 1:
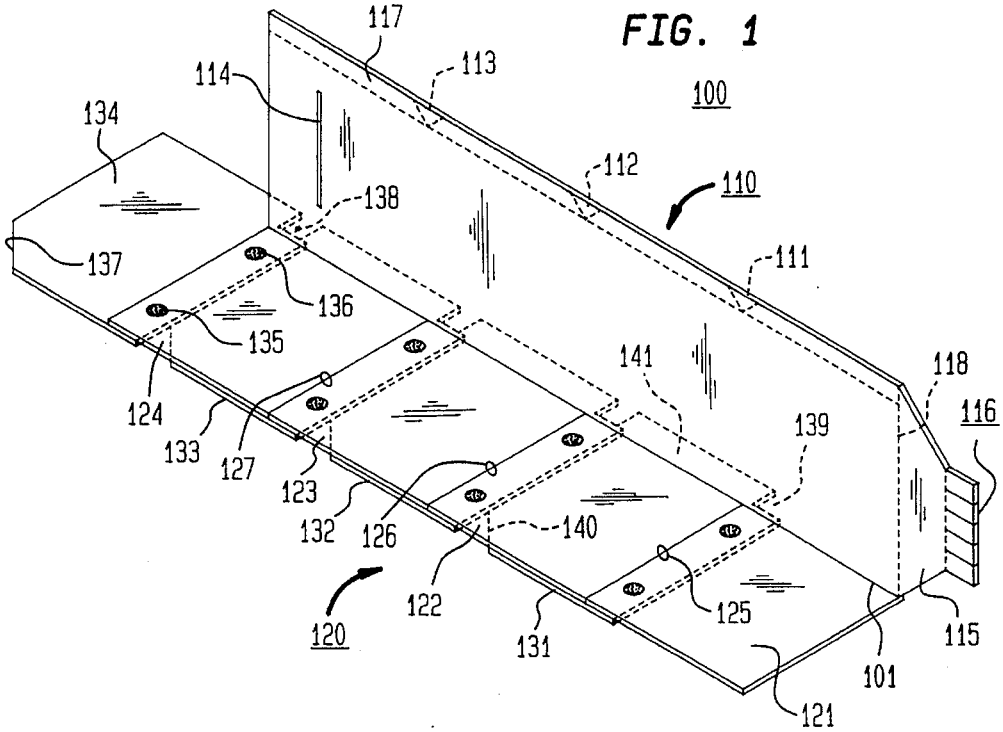
FIG. 1 illustrates the L-shaped pitch pocket in its unfolded state.

With reference to FIG. 1, there is shown fully a assembled pitch pocket 100 in its unfolded state. Pitch pocket 100, L-shaped in its cross-section, is composed of vertical wall 110 and horizontal wall 120 initially both formed from a unitary piecepart of light-gauge metal stock by bending the unitary piecepart at bend 101. Horizontal wall 120 has three slits 125, 126, and 127 cut width-wise from the front tip of wall 120 to the base of vertical wall 110. These three slits partition wall 120 into four square-shaped flaps 121–124 of substantially equal dimensions (e.g., each flap of an exemplary pitch pocket is nominally 4×4 inches). In addition, horizontal wall 120 is arranged with four substantially identical corner fillers 131–134 fastened to the underside of flaps 121–124, respectively, by, for example, spot-welding—welds 135 and 136 are two such points whereby filler 134 is attached to the underside of flap 124. Each corner filler (say 134) is substantially square (e.g., for the same exemplary pitch pocket, each filler is nominally 4⅝×4⅝ inches), but each filler has taper 137 and notch 138, the function of which will be described shortly. The corner fillers are aligned with the front tips of the flaps so that the rear portion of the corner fillers project rearwardly beyond the base of vertical wall 110 (as pointed at by reference numeral 141). This rearwardly projection portion eventually tucks under the right side of each left adjacent flap as pitch pocket 100 is folded, as will be described below.

Figure 2:
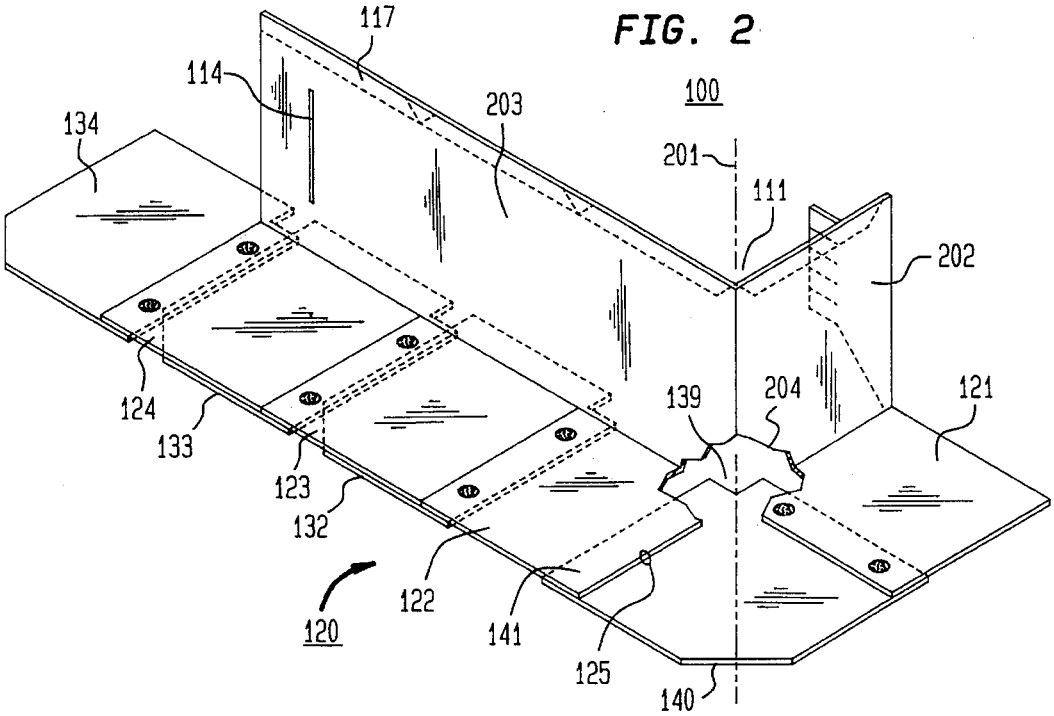
FIG. 2 illustrates the L-shaped pitch pocket upon folding about the first of its low stress points.

Vertical wall 110 includes ridge 117 along its top tip; ridge 117, which adds to the rigidity of vertical wall 110, is formed by folding over the initially free end of vertical wall 110. Prior to forming ridge 117, three notches 111–113 are cut in the initially free end of vertical wall 110. The fold that forms ridge 117 aligns with the base of the cuts for notches 111–113. The notches are cooperatively aligned with slits 125–127, respectively, in horizontal wall 120. Each notch-slit pair is cooperatively arranged so that vertical wall 110 may be bent using light hand-pressure about an imaginary vertical axis through each notch and the tip of the corresponding slit at the base of vertical wall 110; such an axis, labeled with reference numeral 201, is shown dashed in FIG. 2 for notch 111 and slit 125. As illustrated in FIG. 2, section 202 of vertical wall 110 is bent until this section forms substantially a right-angle with the remaining portion 203 of vertical wall 110. As section 202 is bent about axis 201, corner filler 131 slides from its tucked position along the underside of horizontal wall 120 to the open, visible position of filler 131 illustrated in FIG. 2. Now the formerly rearwardly projecting portion of filler 131, designated by reference numeral 141 in FIG. 2, overlaps the right hand side of left-adjacent flap 122 to form a composite wall with no gaps. The function of notch 139 in filler 131 is readily observed with reference to region 204, namely, notch 139 eliminates a projecting corner of filler 131, and thereby allows the inner wall of section 202 to form a right angle with the back of section 203 without any interfering projection from filler 131 in the horizontal plane containing horizontal wall 120. Notch 139 is formed by removing a square section from the appropriate corner of filler 131 (nominally ⅝×⅝ inches for the exemplary pitch pocket). As is also now visible from FIG. 2, taper 140 in filler 131 eliminates a sharp point in the folded piecepart 100.

Before continuing with the folding operation, reference is again made to FIG. 1 wherein vertical slot 114 is shown in vertical wall 110 proximate to its left end. Also, mitered, right-angle tab 115 having fingers 116 at the free end of tab 115 are shown in vertical wall 110; tab 115 and fingers 116 are formed as an integral part of vertical wall 110 at its right end. Tab 115 and slot 114 are cooperatively arranged so that hand-bendable fingers 116 may be inserted in slot 114 at the end of the folding operation to hold pitch pocket 100 in place, as more fully described shortly.

Figure 3:
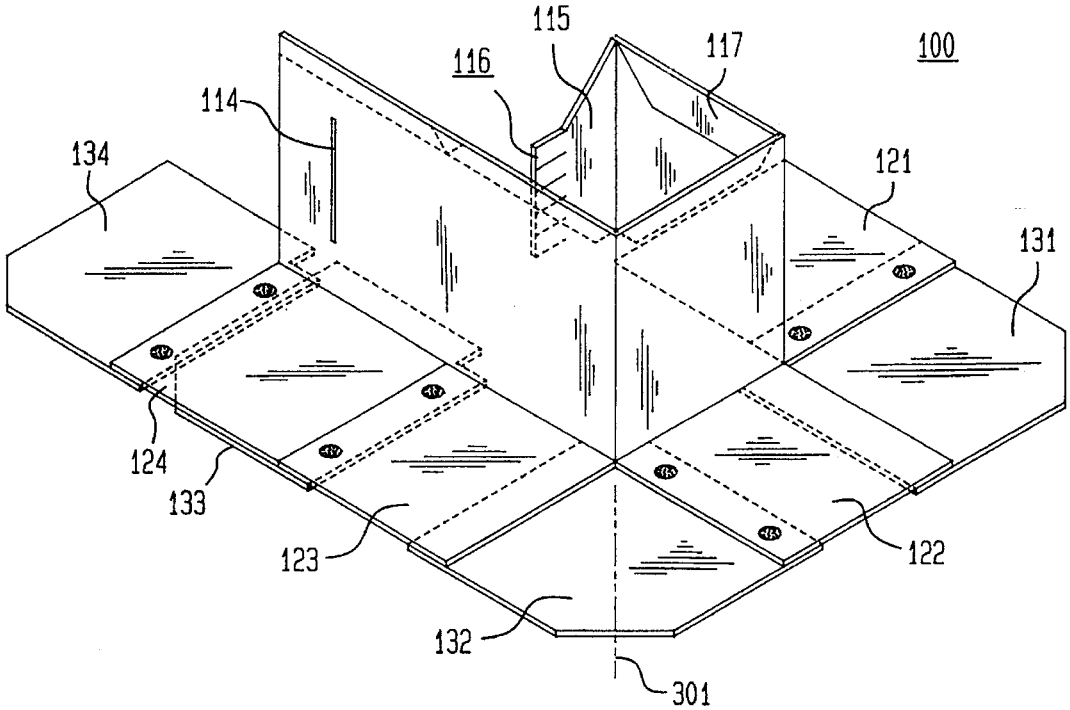
FIG. 3 illustrates the L-shaped pitch pocket upon the successive folding about the first and then the second of its low stress points.

Now, with reference to FIG. 3, there is shown pitch pocket 100 after a second folding operation, about imaginary vertical axis 301, has been effected on pocket 100 in its state as depicted in FIG. 2. Now, corner filler 132, which originally was in a tucked position under flap 123, is readily visible. Also, tab 115 and fingers 116 are now visible.

Figure 4:
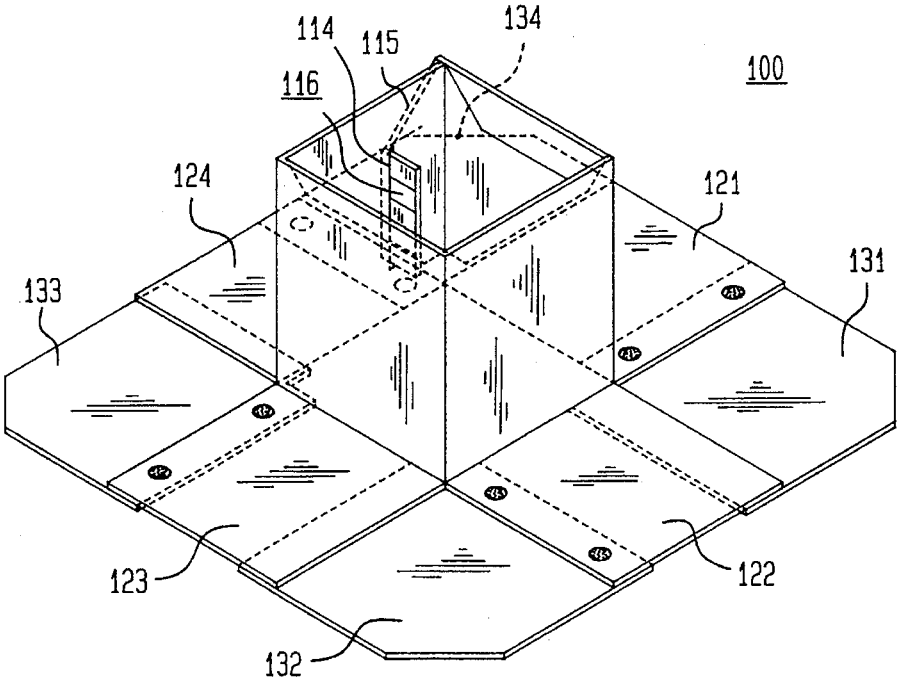
FIG. 4 illustrates the L-shaped pitch pocket upon the complete folding about its three low stress points wherein the pocket is fully assembled by interlocking the tabs and fingers into the slot in the vertical wall slot.

Two more bending operations produce the completed folded pitch pocket 100 illustrated in FIG. 4. All corner fillers 131–134 have been moved from their tucked-to-untucked position. Moreover, fingers 116, which have been inserted through slot 114, are positioned to be bent which hand-pressure to lock fingers 116 in place against the backside of vertical wall 110, and thereby fixedly hold the vertical wall 110 of pitch pocket 100 into a substantially square shape. The length of and miter to tab 115 are such that fingers 116 fit snugly into slot 114 to essentially eliminate the flow of pitch when introduced at the work site.

As is readily deduced from the foregoing description of the mechanical construction of pitch pocket 100, the method for fabricating pitch pocket 100 includes the following steps applied to raw stock such as light-gauge metal: (1) shearing the raw stock to form (i) a flat, essentially rectangular piecepart (e.g., nominally 8×16 inches) which will be bent into vertical wall 110 (e.g., nominally 4×16 inches) and horizontal wall 120 (e.g., nominally 4×16 inches) in a later step, the rectangular piecepart including mitered tab 115 with an uncut tip portion for forming fingers 116 (tab 115 is tapered from nominally 4 inches to 2½ inches and is nominally 1⅛ inches in width, and fingers 116 are nominally ½ inch wide and ¾ inch long); and (ii) four substantially square corner fillers 131–134 each having a taper exemplified by taper 137 and a notch exemplified by notch 138 of filler 134; (2) bandsawing slits 125–127 in a front-to-back manner in the flat piecepart to a depth equal to the width of the horizontal wall (e.g., nominally 4 inch deep cuts) as well as the fingers 116 and notches 111–113 (each nominally ¼ inch) in the vertical wall; (3) punching slot 114 proximate to the free end of vertical wall 110 (nominally 2½ inches long by ⅛ inch wide and 1 inch from the left-hand end of vertical wall 110); (4) bending: the flat piecepart in the middle of its long dimension (e.g., the 16 inch dimension) to form vertical wall 110 and horizontal wall 120; tab 115 backwards until it is perpendicular with the right-hand side of vertical wall 110 to form bend 118; and top edge of vertical wall 110 to form ridge 117 (e.g. nominally 3/16 inch lip); and (5) spot welding corner fillers 131–134 to the underside of flaps 121–124 such that the fronts of the fillers and flaps align, with each filler overlapping the flap to which it is welded (e.g., a nominal overlap is ¾ inch).

Whereas the description of the pitch pocket 100 and the concomitant methodology has been elucidated using a set of standard fabrication techniques (such as shearing and bandsawing), it is readily apparent to one with ordinary skill in the art that other fabrication techniques may be advantageously utilized. For example, other suitable processing techniques include the use of a: (a) punch press, either manual or automated; (b) laser cutter; or (c) abrasive water jet.

Figure 5:
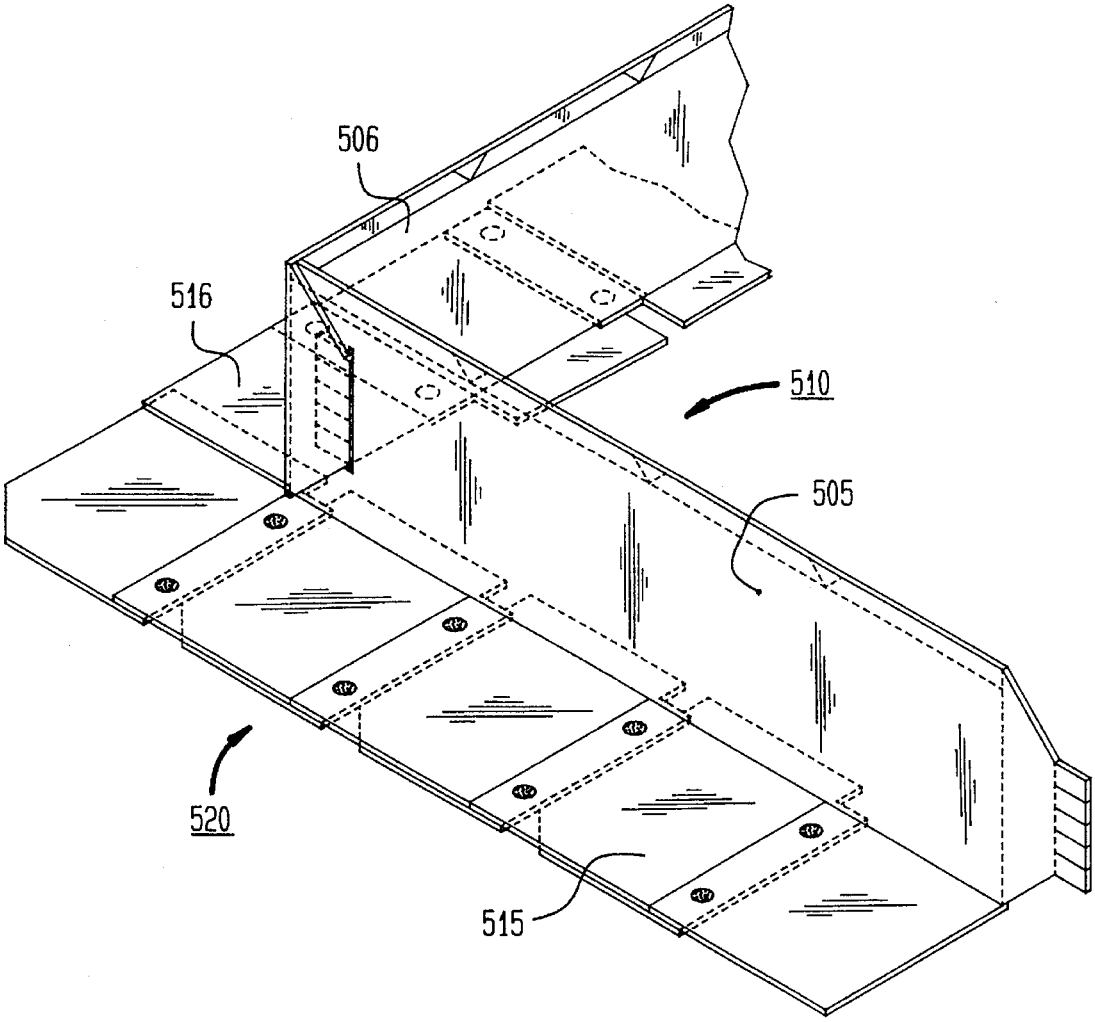
FIG. 5 illustrates the interconnection of two L-shaped, unfolded pitch pockets to produce a composite pitch pocket.

In order to make the pitch pockets in accordance with the present invention even more adaptable to work site conditions, each pitch pocket 100 is designed and fabricated so that two or more pitch pockets may be linked to form a corner junction in a modular fashion, as illustrated in FIG. 5, to form an interlocked vertical wall 510 composed of separate vertical walls 505 and 506, respectively, and horizontal wall 520 composed of separate horizontal walls 515 and 516, respectively. Four such individual pitch pockets could then encompass a roof protuberance requiring four times the dimensions of each individual pitch pocket. Two such individual pitch pockets, bent in the middle of each, could encompass a roof projection requiring two times the dimensions of each individual pitch pocket. Moreover, a plurality of individual pitch pockets could be formed into other geometrical shapes, such as an octagon, whenever the particular work site condition required such an arrangement.

Although various embodiments which incorporate the teachings of the present invention have been shown and described in detail herein, those skilled in the art can readily devise many other varied embodiments that still incorporate these teachings.

We claim:

1. An angular pitch pocket comprising a vertical wall and a horizontal wall, said horizontal wall and said vertical wall being adapted for cooperatively bending said vertical wall about one or more vertical axes to form the angular pitch pocket, the pitch pocket further comprising one or more fillers attached to said horizontal wall, said fillers being sized and positioned to form a composite horizontal wall composed of said horizontal wall and said fillers surrounding said vertical wall, upon bending said vertical wall about at least one of said vertical axes.

2. The pitch pocket as recited in claim 1 wherein said vertical wall includes means for fixedly holding the pitch pocket in the angular shape obtained by bending said vertical wall about said at least one vertical axes.

3. A pitch pocket comprising an elongated, L-shaped, thin piecepart having a vertical wall and a horizontal wall, said horizontal wall being partitioned into a plurality of flaps having slits separating adjacent flaps, said flaps being joined to the base of the vertical wall, said vertical wall having a plurality of notches on its top tip, said notches and said slits being cooperatively aligned so that said vertical wall is bendable about a plurality of vertical axes in correspondence to the number of aligned notches and slits, said vertical wall also having a vertical slot proximate to one end and having a bendable tab formed at the end opposite to said vertical slot, said slot and said tab cooperatively arranged so that said tab inserts into said slot upon bending of said vertical wall about the vertical axes, and said pitch pocket further comprising flat, thin, substantially rectangularly-shaped fillers equal to the number of flaps, each of said fillers attached to the underside of a corresponding one of said flaps, with one of said fillers projecting beyond said horizontal wall at one end, and each remaining one of said fillers extending from the flap to which the filler is attached to an adjacent one of said flaps, thereby overlapping a corresponding one of said slits between adjacent ones of said flaps, said fillers being sized to form a composite horizontal wall composed of said flaps and said fillers when said piecepart is folded about the vertical axes.

4. The pitch pocket as recited in claim 3 having four flaps and four fillers to thereby form a square pitch pocket upon folding.

5. The pitch pocket as recited in claim 3 wherein said vertical wall and said horizontal wall are formed from a unitary stock of light-gauge metal.

6. The pitch pocket as recited in claim 3 wherein said tab includes a plurality of bendable fingers which are inserted into said slot to fixedly hold said piecepart when folded.

7. The pitch pocket as recited in claim 3 wherein said tab includes a taper arranged at an angle relative to said vertical wall and a plurality of bendable fingers which are inserted into said slot to fixedly hold said piecepart when folded.

* * * * *